US010919742B2

(12) United States Patent
Lülfing

(10) Patent No.: US 10,919,742 B2
(45) Date of Patent: Feb. 16, 2021

(54) ENDLESS CABLE WINCH

(71) Applicant: SafeWorks, LLC, Tukwila, WA (US)

(72) Inventor: Frank Lülfing, Wietze (DE)

(73) Assignee: SafeWorks, LLC, Seattle, WA (US)

( * ) Notice: Subject to any disclaimer, the term of this patent is extended or adjusted under 35 U.S.C. 154(b) by 0 days.

(21) Appl. No.: 16/240,536

(22) Filed: Jan. 4, 2019

(65) Prior Publication Data

US 2019/0210846 A1 Jul. 11, 2019

Related U.S. Application Data

(60) Provisional application No. 62/614,254, filed on Jan. 5, 2018.

(51) Int. Cl.

| | |
|---|---|
| ***B66D 1/50*** | (2006.01) |
| ***B66D 1/12*** | (2006.01) |
| ***B66D 1/58*** | (2006.01) |
| ***B66D 1/74*** | (2006.01) |

(52) U.S. Cl.

CPC ..... *B66D 1/50* (2013.01); *B66D 1/12* (2013.01); *B66D 1/58* (2013.01); *B66D 1/7447* (2013.01); *B66D 1/7489* (2013.01); *B66D 2700/0141* (2013.01)

(58) Field of Classification Search

CPC ... B66D 1/60; B66D 1/56; B66D 1/58; B66D 1/7447; B66D 1/12; B66D 1/48

See application file for complete search history.

(56) References Cited

U.S. PATENT DOCUMENTS

| | | | | |
|---|---|---|---|---|
| 2,080,804 A | | 5/1937 | Brantly | |
| 2,626,039 A | * | 1/1953 | Wetherington | B65G 41/002 198/301 |
| 2,723,833 A | * | 11/1955 | Burfeind | B66D 1/00 254/273 |
| 3,026,462 A | * | 3/1962 | Morey | B66C 13/26 388/816 |
| 4,588,167 A | | 5/1986 | Finzel | |
| 4,623,124 A | | 11/1986 | Lewis | |

(Continued)

OTHER PUBLICATIONS

International Patent Application No. PCT/US2019/12368; Int'l Search Report and the Written Opinion; dated Apr. 1, 2019; 9 pages.

(Continued)

*Primary Examiner* — Emmanuel M Marcelo
(74) *Attorney, Agent, or Firm* — BakerHostetler

(57) ABSTRACT

This disclosure relates to an endless cable winch including a drive unit having an engine configured to generate a torque. The endless cable winch further including an output unit connected to the drive unit, the output unit including a power transmission assembly coupled to the drive unit, the power transmission assembly configured to apply a driving force to a cable. The endless cable winch further including a lifting force limiting device configured to stop the drive unit as soon a predetermined driving force is exceeded. In doing so, this system is also transferable to winches with multiple engines. The engine and the output unit can be movable relative to one another, and the lifting force limiting device can be configured to stop the drive unit based on the relative movement of the drive unit and the engine.

13 Claims, 8 Drawing Sheets

(56) References Cited

U.S. PATENT DOCUMENTS

| | | | | |
|---|---|---|---|---|
| 5,002,259 | A | 3/1991 | Manning et al. | |
| 5,090,666 | A * | 2/1992 | May | B66D 1/7415 254/329 |
| 5,205,219 | A | 4/1993 | Groskreutz et al. | |
| 5,273,257 | A | 12/1993 | Perkins | |
| 5,533,711 | A * | 7/1996 | Pickrell | B65H 51/30 242/396.9 |
| 5,597,080 | A * | 1/1997 | Culwell | B66C 15/00 212/250 |
| 2005/0082517 | A1 * | 4/2005 | Steiner | B62D 43/045 254/323 |
| 2010/0147588 | A1 * | 6/2010 | Terry | B66D 1/42 175/24 |
| 2011/0215285 | A1 | 9/2011 | Akhavein et al. | |
| 2014/0110650 | A1 | 4/2014 | Rottlaender et al. | |

OTHER PUBLICATIONS

International Patent Application No. PCT/US2019/012368; Int'l Preliminary Report on Patentability; dated Jul. 16, 2020; 7 pages.

* cited by examiner

A-A

ENDLESS CABLE WINCH

TECHNICAL FIELD

The present disclosure is related to embodiments of an endless cable winch with a drive unit having an engine configured to generate a torque, an output unit connected to the drive unit. The output unit having a power transmission assembly coupled to the drive unit and configured to apply a driving force to a cable. The endless cable winch further having a lifting force limiting device configured to stop the drive unit as soon a predetermined driving force is exceeded.

BACKGROUND

Winches have been generally known for a long time and are used throughout all industry sectors to lift loads and persons, especially bridging differences in altitude. A specific type of winches are the referred to as endless cable winches, where a cable is passed through a winch instead of being rolled up on the winch, for example in a reel. Due to gravity or due to an acting load the cable may, for example, hang down on one or both sides of the endless cable winch, so that the endless cable winch does not need to store the part of the cable that has passed through the endless cable winch. In principle, this means that endless cable winches have an unlimited lifting height and/or tension length. These endless cable winches are used in particular when an infrastructure configured to attach external winches is temporarily made available or may temporarily be made available in a hoist shaft or at a building.

Endless cable winches are used for both the transport of people and the transport of material. Electric engines are used, for example, to drive endless cable winches whose high engine speeds are reduced with the aid of transmission stages integrated into the winch (by reducing engine speed at a particular rate). The transmission is usually coupled to a traction sheave associated with an output unit. The traction sheave is at least in part wrapped up by the cable, which has been passed through the endless cable winch. By generating a frictional engagement between the cable and the traction sheave a power transmission may occur. The torque generated by the engine is thus transferred to the traction sheave and converted into a driving force.

Due to operational and occupational safety reasons a lifting force limit of the winches is regulated for many types of winches, in particular when it comes to winches for passenger elevation (according to EN 1808). The maximum lifting force permitted for operating winches for passenger elevation is, according to one example, 1.25 times the load capacity. The winches may be equipped with a lifting force limiting device configured to interrupt the lifting operation If the maximum load is exceeded.

As part of this process prior art devices aim to detect the load capacity by measuring the cable tension of the cable passed through the endless cable winch. For this purpose, the cable is substantially deviated across the lifting direction by a deviation device and the deviation force necessary is measured. The larger the deviation force necessary, the larger also the cable tension, which in turn indicates that the lifting load is also larger. Even though the type of cable force measurement described above essentially guarantees safe operation, it is not very precise. In addition, this type of monitoring includes the disadvantage that a deflecting force is continually acting on the cable, which on the one hand causes increased wear and tear at the deviation device (for example pressure rollers) and running noises.

Against this background the object of the present disclosure is to provide an endless cable winch attenuating the drawbacks described above as much as possible, and in particular enabling a more precise detection of the load situation at a lower susceptibility to wear and tear.

SUMMARY

The embodiments of an endless cable winch described in the present disclosure solves the stated objectives. The endless cable winch can include a drive unit having an engine configured to generate a torque, an output unit connected to the drive unit. The drive unit having a coupled power transmission assembly configured to apply a driving force onto a cable coupled to the drive unit. The endless cable winch can further include a lifting force limiting device configured to stop the drive unit when a predetermined drive force is exceeded. The engine and the output unit can be movable relative to one another, and the lifting force limiting device is configured to stop the drive unit based on the relative movement of the drive unit and the engine.

The endless cable winch can thereby make use of the realization that the maximum lifting force may be determined by methods other than the detection of the cable tension. In particular, the endless cable winch described herein can makes use of the realization that the engine of the drive unit for the purpose of achieving a particular lifting force must deliver a particular torque. The torque generated by the engine is transferred via the drive unit, preferably featuring a transmission, onto the power transmission assembly and in doing so, onto the output unit guaranteeing the movement of the cable relative to the endless cable winch.

Since, in accordance with an embodiment of the invention, the engine and the output unit are movable relative to one another, relative movement between the output unit and the drive unit is created when generating torque through the engine. The extent of the relative movement proportionally corresponds to the torque generated, so that monitoring the relative movement via this method reliably delivers a statement about both the torque generated and the lifting load applied. This type of monitoring is performed entirely independent of the cable itself, meaning that inhomogeneities of the cable rigidity or the cable geometry no longer play a role in determining the lifting load.

Preferably, the engine and the output unit can be supported against each other via a torque arm and for that purpose the torque arm can feature both a drive-side support structure and an output-side support structure. The drive-side and output-side support structures are preferably arranged with respect to one another so that they are spaced from one another in a load-free state and approximate one another when the lifting load on the endless cable winch is increased. In a load-free state or in a state underneath the application of the maximum lifting load, both the drive-side and output-side support structures preferably feature at least a minimum distance between one another. This principle can also be simultaneously applied onto several engines if their respective torque support structures are connected, via a connecting rod for example.

According to a preferred embodiment of the invention, the lifting force limiting device can have a switch which is set up to switch off the drive unit in the case in which both the drive-side and output-side support structures remain below the predetermined minimum distance to one another. This switch preferably can be configured as an approximation sensor or a displacement sensor, and preferably the approximation can be performed optically, inductively or capacitively. According to an alternative preferred embodiment, the switch is contact-sensitive and set up to switch off the drive unit in the case in which both the drive-side and output-side support structures touch each other.

The lifting force limiting device can also be set up to switch off the drive unit in the case in which the distance between the drive-side and output-side support structures is measured as zero. Preferably, the contact sensitive switch can have an electric contact sensor or a contact bridge configured to trigger a change of state in an electrical circuit when the distance between the drive-side and output-side support structures is measured as zero. Depending on whether the normal state of the circuit is defined with regards to the closed electrical circuit or the open electrical circuit, the switching procedure of the switch is preferably triggered when the drive-side and output-side support structures touch each other by interrupting the electrical circuit or closing the electrical circuit, causing the lifting force limiting device to stop the drive unit of the endless cable winch.

Optionally, the lifting force limiting device can be set up to stop the drive of the endless cable winch, to stop the drive unit, or to stop both the drive and the drive unit when a support structure acting on the torque arm exceeds a predetermined value. For this purpose, the lifting force limiting device preferably has a switch interacting with one or more force measuring devices. The one or more force measuring devices can preferably be arranged in such a way that the one or more force measuring devices measure the force created through contact of the drive-side and output-side support structures to one another, for example via a piezoelectric force sensor. In such a case, a switching operation according to this alternative can be triggered if a force is measured, which in turn is associated with a torque acting between the drive unit and the output unit through the application of a simple calculation, corresponding to a lifting load, which in turn is higher than the allowable maximum lifting load (known for each winch model).

According to another preferred embodiment of the disclosure, the lifting force limiting device can have a restoring element, preferably a spring, configured to apply a restoring force against an approximation movement of both the drive-side and output-side support structures. The restoring element can preferably be constructed as a tension or compression spring or as a pneumatic spring element. Preferably, multiple of these restoring elements are foreseen.

Further preferably, the lifting force limiting device has a biasing member configured to apply to the restoring element a biasing force directed against the approximation movement of the drive-side and output-side support structures. In case springs are used as the restoring element, the biasing member may preferably be configured as an adjusting bolt or may be realized through a compressed gas connection at pneumatic spring elements. Particularly preferably, the biasing force can be set up in such a way that the drive-side support structure and the output-side support structure keep, exceed, or both the predetermined minimum distance between the drive-side and output-side support structures until there is a stress case, in which the maximum lifting load is exceeded.

Further preferably, the lifting force limiting device can have a damping element configured to delay the approximation movement of the drive-side and output-side support structures to one another. A shock absorber, as is generally available, can preferably be used as the damping element. A damping effect proportional to velocity is preferably achieved by the damping element in a preferably fluid or mechanical way or through friction. Through the energy dissipation created by the damping element, jerky movements, for example due to sudden load changes or similar unforeseen disruptions, are mitigated when operating the winch and the lifting force limiting device is prevented from mistakenly stopping the drive of the endless cable winch, even though, except for the unforeseen event, no other exceeding of the maximum lift load has taken place.

According to a preferred alternative of the invention, the drive unit can have a transmission, which is rotationally positioned relative to the engine and firmly connected to the output unit and whereby the drive-side support structure is firmly connected to the engine. In this context and also with regard to the above and below explanations, something is considered as firmly connected if the parts in their assembled and operable state are not movable relative to one another, but may, under certain circumstances, be disassembled from one another. According to this embodiment, the relative movement of the drive unit and the output unit to one another can be achieved through the fact, that when generating the torque, a relative movement between the engine and the transmission is taking place, which is made possible through the positioning of both parts to one another. Preferably, the relative movement is intercepted by the torque arm and the approximation of the support structure enveloped by the torque arm is detected, as explained above with regard to the preferred embodiments.

According to a second preferred alternative of the invention, the drive unit can have a transmission which is firmly connected to the engine and rotationally positioned relative to the output unit and whereby the drive-side support structure is firmly connected to the engine, the transmission, or both. In this alternative and the first alternative described above of the invention, it is common that a relative movement between two components can be made possible through a rotational bearing and the components can be arranged at various places along the power transmission chain.

According to the second preferred alternative described herein, the relative movement can be made possible due to a rotational bearing between the transmission and the output unit. Due to the design of the transmission, under certain circumstances it is possible that of the forces occurring and the torque occurring are significantly higher than in the first preferred alternative. This is compensated through appropriate dimensioning of the components. The additional constructional effort is offset through the fact that due to the higher and less unambiguous force ratios, switches (and/or sensors etc.) with less sensitivity can be used.

According to the said alternative in which the transmission is rotationally positioned relative to the engine and firmly connected to the output unit, the output-side support structure can be alternatively or additionally firmly connected to the transmission.

According to a further preferred embodiment, the endless cable winch can have an electronic control device interacting with the drive unit and the lifting force limiting device in such a signal-processing way, that a first signal generated by the switch representing a value below the predetermined minimum distance is transmitted to the control device, and on this basis, a control command and/or a (second) signal to stop the drive is transmitted to the drive unit. Generating the first signal may for example be generating or applying a voltage or current signal, which is either actively generated (for example through the switch) or is passively generated through opening and/or closing of an electric contact of an electrical circuit. Alternatively, the first representative signal can be a measuring value which has been transmitted in form of a corresponding data signal.

Optionally, according to a preferred embodiment of the invention, the control device can be set up to hold the endless cable winch in a constant position relative to of the cable passed through the output unit, or to lower the endless cable winch along the cable passed through the output unit when the predetermined minimum distance between the drive-side and output-side support structures is not achieved. The primary task of the lifting force limiting device is to prevent a lifting operation when the allowable maximum lifting load is exceeded. Lowering the vehicle transported by the endless cable winch can, however, furthermore be facilitated, especially since this facilitates the reduction of the lifting load in an offloading position situated at the bottom.

Therefore, if the maximum lifting load is exceeded, and in doing so, the predetermined minimum distance between the supporting structures is not achieved, according to the invention, the control device first generates a holding of the endless cable winch in constant position relative to the cable by transmitting a corresponding (second) signal to the drive unit. Optionally, thereupon, the lowering, preferably with reduced velocity, is either possible in an automated way or via a manual control command.

According to a further preferred embodiment, the control device is set up to release the drive of the endless cable winch via the drive unit if the predetermined minimum distance has been achieved or exceeded.

BRIEF DESCRIPTION OF THE DRAWINGS

The foregoing summary, as well as the following detailed description of illustrative embodiments of the application, will be better understood when read in conjunction with the appended drawings. For the purposes of illustrating the present disclosure, there is shown in the drawings illustrative embodiments. It should be understood, however, that the application is not limited to the specific embodiments and methods disclosed, and reference is made to the claims for that purpose. In the drawings:

DETAILED DESCRIPTION OF ILLUSTRATIVE EMBODIMENTS

Figure 1:
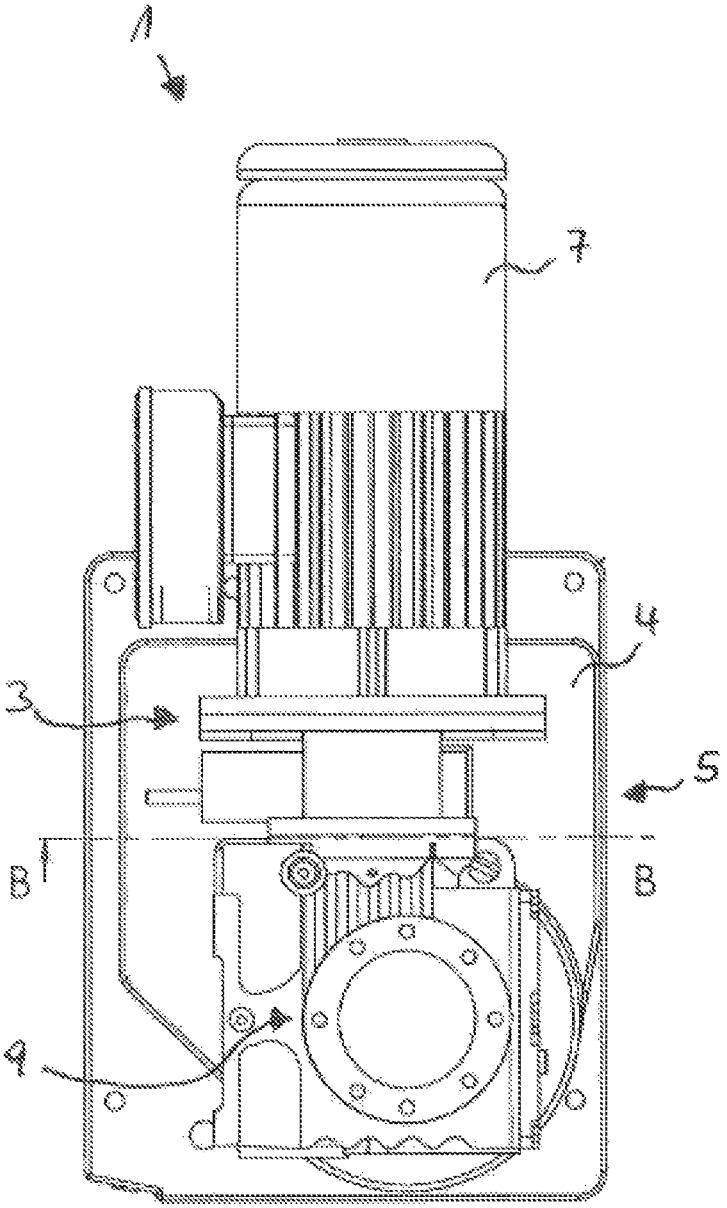
FIG. 1 is a first side elevation view of an endless cable winch according to one embodiment.

Aspects of the disclosure will now be described in detail with reference to the drawings, wherein like reference numbers refer to like elements throughout, unless specified otherwise. Certain terminology is used in the following description for convenience only and is not limiting. The term "between" as used herein in reference to a first element being between a second element and a third element with respect to a direction means that the first element is closer to the second element as measured along the direction than the third element is to the second element as measured along the direction. The term "between" includes, but does not require that the first, second, and third elements be aligned along the direction. Certain features of the disclosure which are described herein in the context of separate embodiments may also be provided in combination in a single embodiment. Conversely, various features of the disclosure that are described in the context of a single embodiment may also be provided separately or in any subcombination.

FIGS. 1 to 4 show an endless cable winch 1 according to a first exemplary embodiment of the disclosure. Endless cable winch 1 can include a drive unit 3 and an output unit 5. Drive unit 3 can include an engine 7 and a transmission 9. Output unit 5 can include a casing 4. As shown, the transmission 9 can be non-rotatably, also referred to herein as firmly, connected to casing 4, preferably through a flange connection, and the engine 7 and the transmission 9 of drive unit 3 can be rotationally coupled to one another, for example by a bearing 11. In doing so, the engine 7 is movable relative to output unit 5 and more specifically to the casing 4 of the output unit 5, in particular rotationally movable.

Furthermore, the endless cable winch 1 can include a torque arm 12, which on the one hand interacts with the drive unit 3 and on the other hand interacts with the output unit 5. For this purpose, the torque arm 12 can include a drive-side support structure 13 (also referred to herein as the first support structure) and an output-side support structure 15 (also referred to herein as the second support structure), which are arranged in a movable way relative to one another. According to one embodiment, the drive side support structure 13 and output-side support structure 15 are configured to be brought into abutment with one another, to generate a supporting motion against the torque applied between the engine 7 and the transmission 9.

Figure 3:
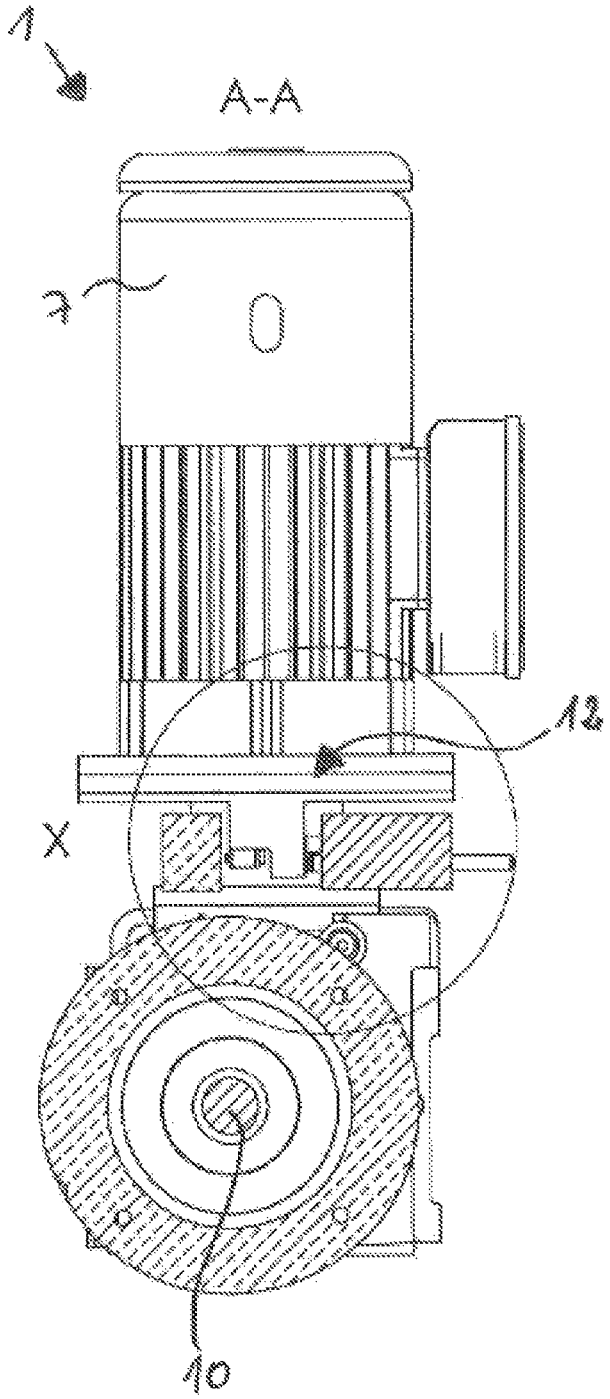
FIG. 3 is a partial cross-sectional view of the endless cable winch illustrated in FIG. 1.
Figure 4:
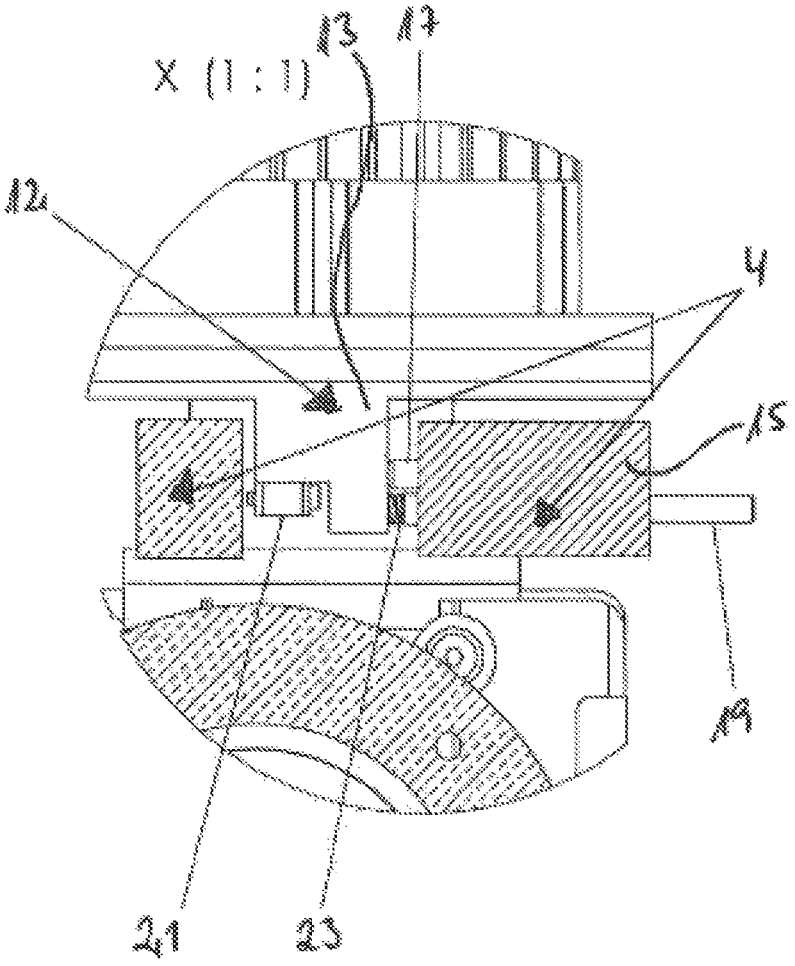
FIG. 4 is an enlarged view of a portion of the partial cross-sectional view illustrated in FIG. 3.
Figure 5:
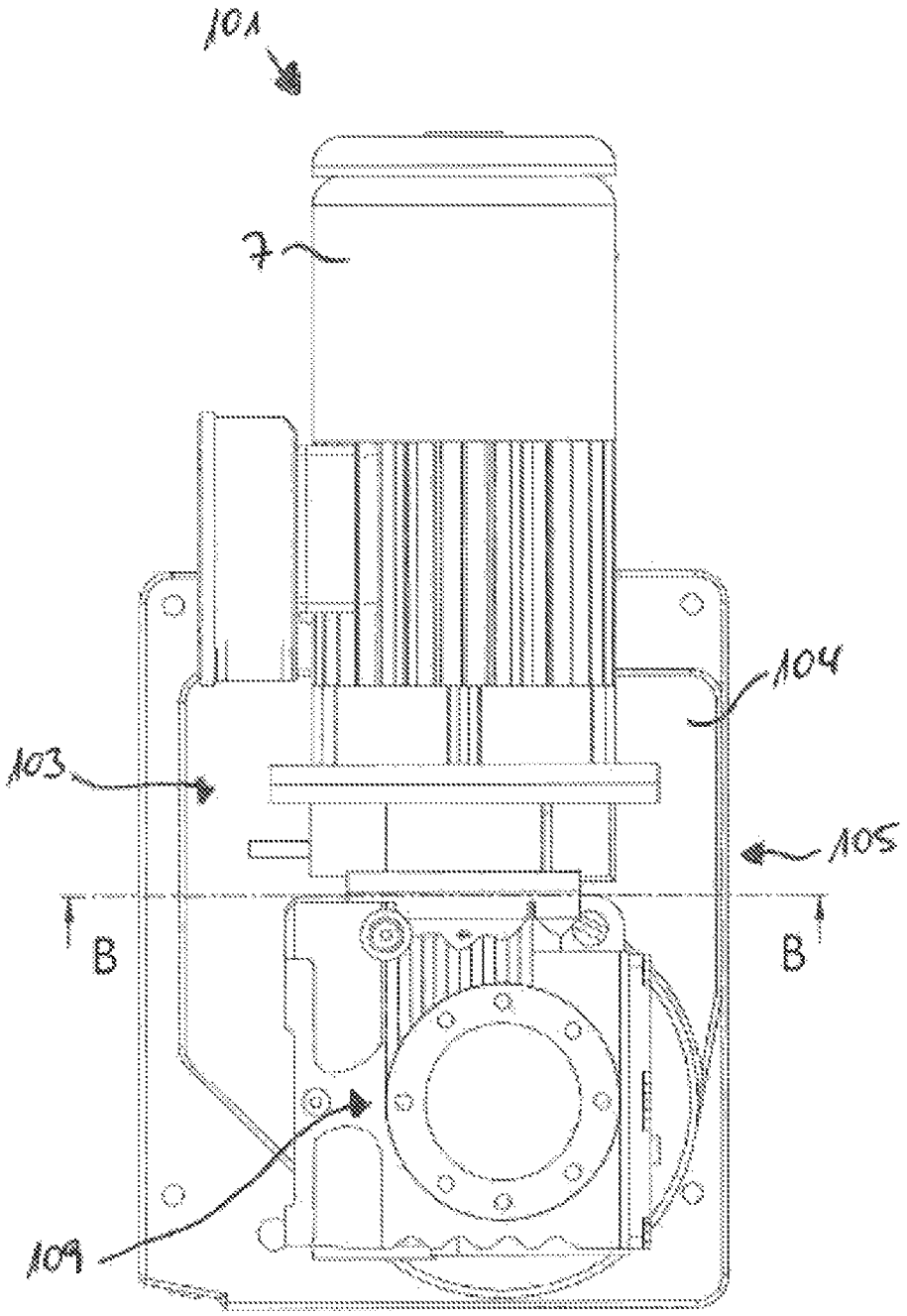
FIG. 5 is a first side elevation view of an endless cable winch according to another embodiment.

The operating method of the lifting force limiting device at the first exemplary embodiment can be seen more specifically by viewing FIGS. 3 and 4. In FIG. 3 a power transmission assembly 10 is shown, illustrated as a shaft with the function to transmit the torques originating from the transmission 9 to the output unit 5. A traction sheave, according to one example, can be connected to the power transmission assembly 10, which are can be arranged within the casing 4.

Figure 2:
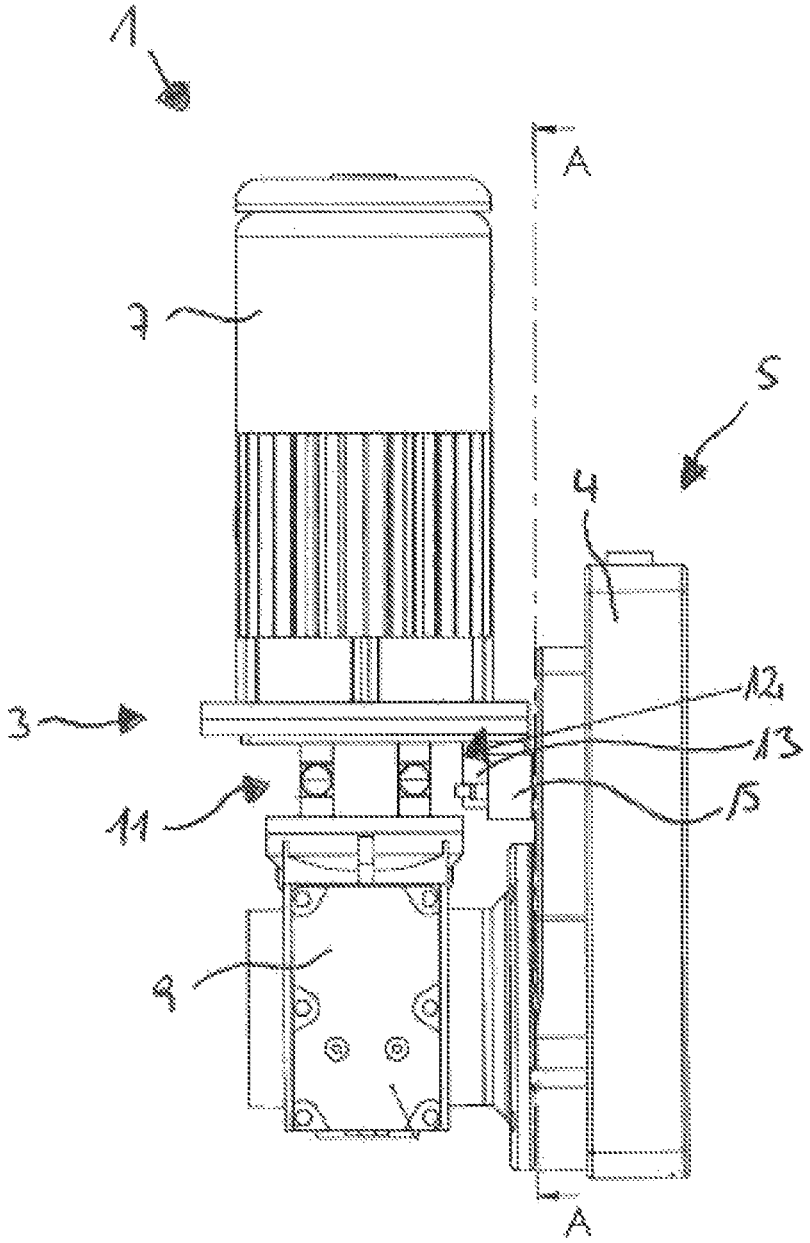
FIG. 2 is a second side elevation view of the endless cable winch illustrated in FIG. 1.

As can be more specifically seen from FIG. 4 in connection with FIGS. 2 and 3, the first support structure 13 and the second support structure 15 relative to the rotational axis between the elements of drive unit 3 (engine 7 and transmission 9) are eccentrically arranged. FIG. 4 shows an operational position, in which drive-side support structure 13 and output-side support structure 15 are approximated to one another, insofar that a switch 21, which is associated with the drive side support structure 13 according the first exemplary embodiment, is in an open position. The open position is achieved through the fact, that the switch 21 is not in contact with a corresponding area of the casing 4.

The operational position according to FIG. 4 is achieved through the fact, that a restoring element 23, configured as a spring, is deflected as a result of the approximation of drive side support structure 13 and the output-side support structure 15 towards one another. The deflection is configured to take place against a restoring force created by the restoring element. In addition, according to the first exemplary embodiment, a biasing element 19, configured as an adjusting bolt according to one embodiment, is provided for, whereby the force necessary for deflecting the restoring element, which must be applied in the direction of the approximation of the drive-side support structure 13 and the output-side support structure 15 to one another, has been increased to a predetermined level.

At a preferred setup of the endless cable winch 1 according to the first exemplary embodiment, the drive-side support structure 13 and the output-side support structure 15 are positioned at a predetermined minimum distance to one another, as long as switch 21 is in a closed state and in contact with the corresponding area of the casing 4. As soon as switch 21 distances itself from the said area, that is when drive side support structure 13 and output-side support structure 15 are moved towards one another (against the restoring force of the restoring element 23), the predetermined minimum distance, preferably resulting from the end position of drive-side support structure 13 relative to casing 4 not shown, is not achieved. In addition, according to the first exemplary embodiment, a damping element 17 can be included in the endless cable winch 1, which delays an approximation of the drive-side support structure 13 and the output-side support structure 15 to one another.

FIGS. 5 to 8 show an endless cable winch 101 according to a second exemplary embodiment of the disclosure. The endless cable winch 101 can be configured in an identical and/or similar way as endless cable winch 1 according to the first exemplary embodiment of the disclosure. Differences include a drive unit 103 can be included having an engine 7 and a transmission 109, whereby the engine 7 and the transmission 109 are non-rotatably connected to one another. The drive unit 103 can be connected to a drive unit 105, whereby the transmission 109 and the drive unit 105 are rotatably positioned relative to one another, for example by a bearing 111.

Between the drive unit 103 and the drive unit 105, a torque arm 112 can be positioned. The torque arm 112 can include a drive-side support structure 113 and an output-side support structure 115. The drive-side support structure 113 can be non-rotatably connected to the transmission 109. The output-side support structure 115 can be non-rotatably connected to a casing 104 of the output unit 105. As well as the torque arm 12 according to the first exemplary embodiment, the torque arm 112 can be eccentrically arranged relative to a rotational axis, however, in this case, eccentrically arranged to the rotational axis between the transmission 109 and the output unit 105.

Figure 7:
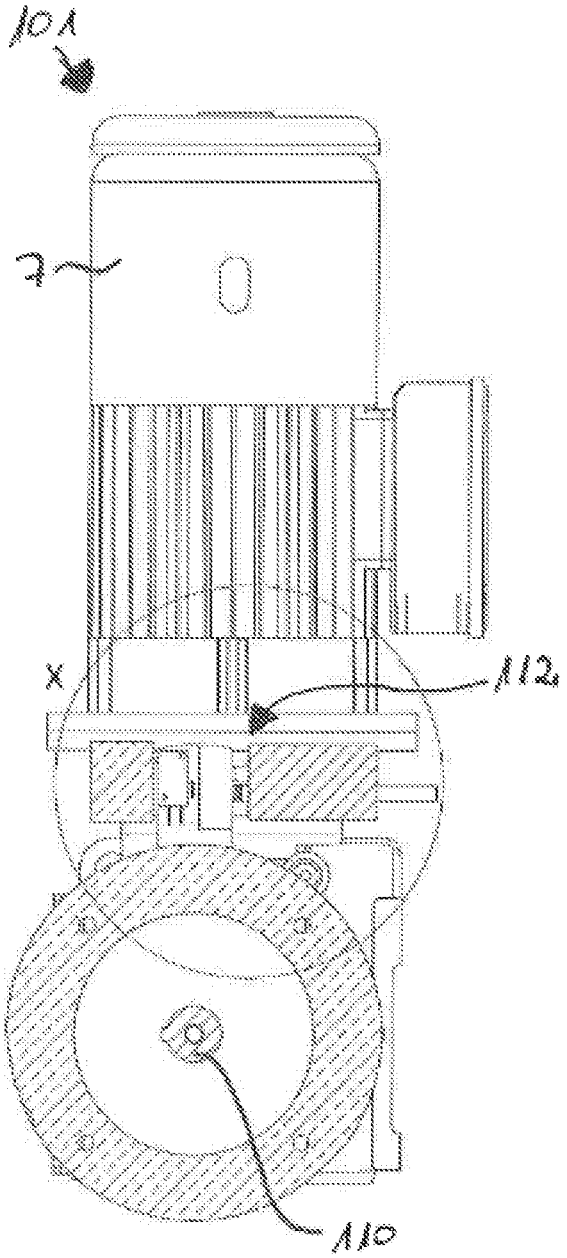
FIG. 7 is a partial cross-sectional view of the endless cable winch illustrated in FIG. 5.

In FIG. 7 a power transmission assembly 110, indicated as a shaft, is shown in sectional view. The power transmission assembly 110 can include essentially the same function as the power transmission assembly 10 according to the first exemplary embodiment of the invention.

Figure 6:
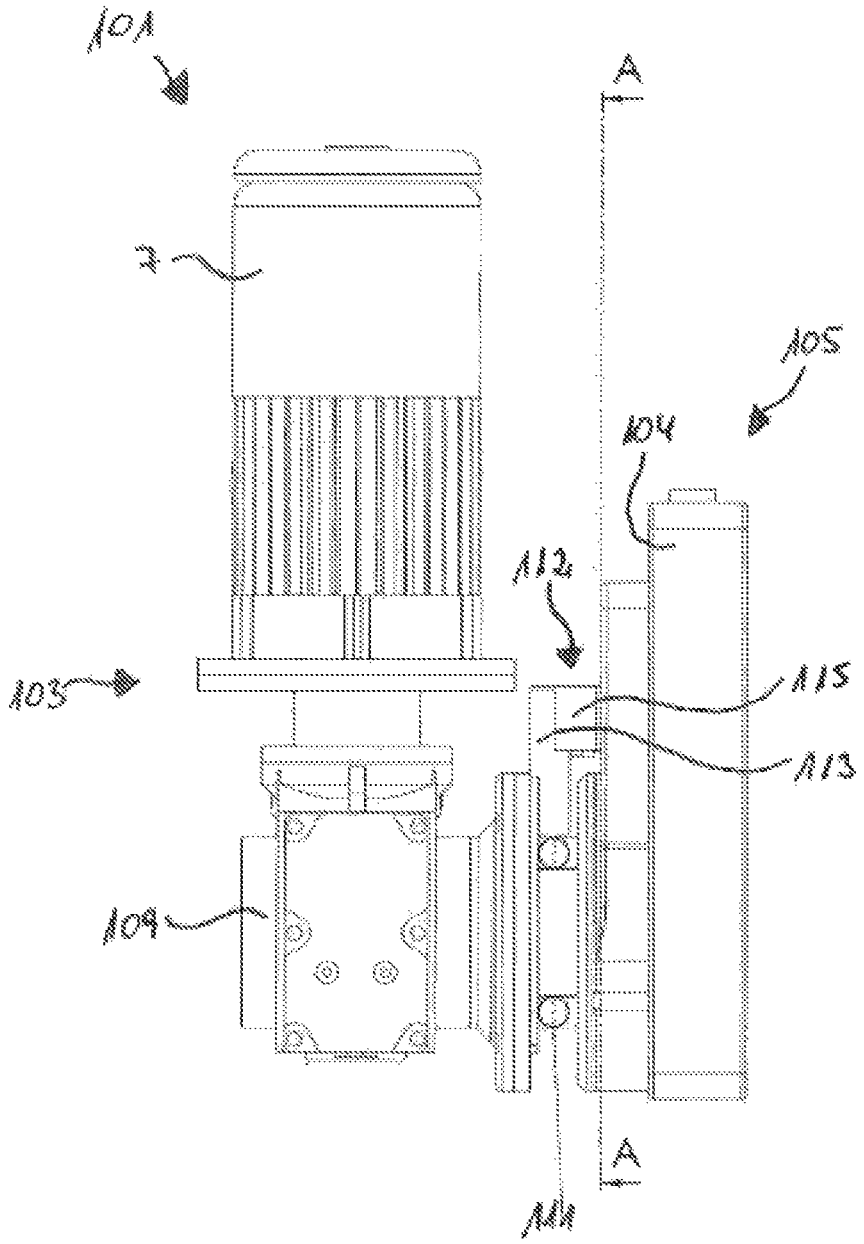
FIG. 6 is a second side elevation view of the endless cable winch illustrated in FIG. 5.
Figure 8:
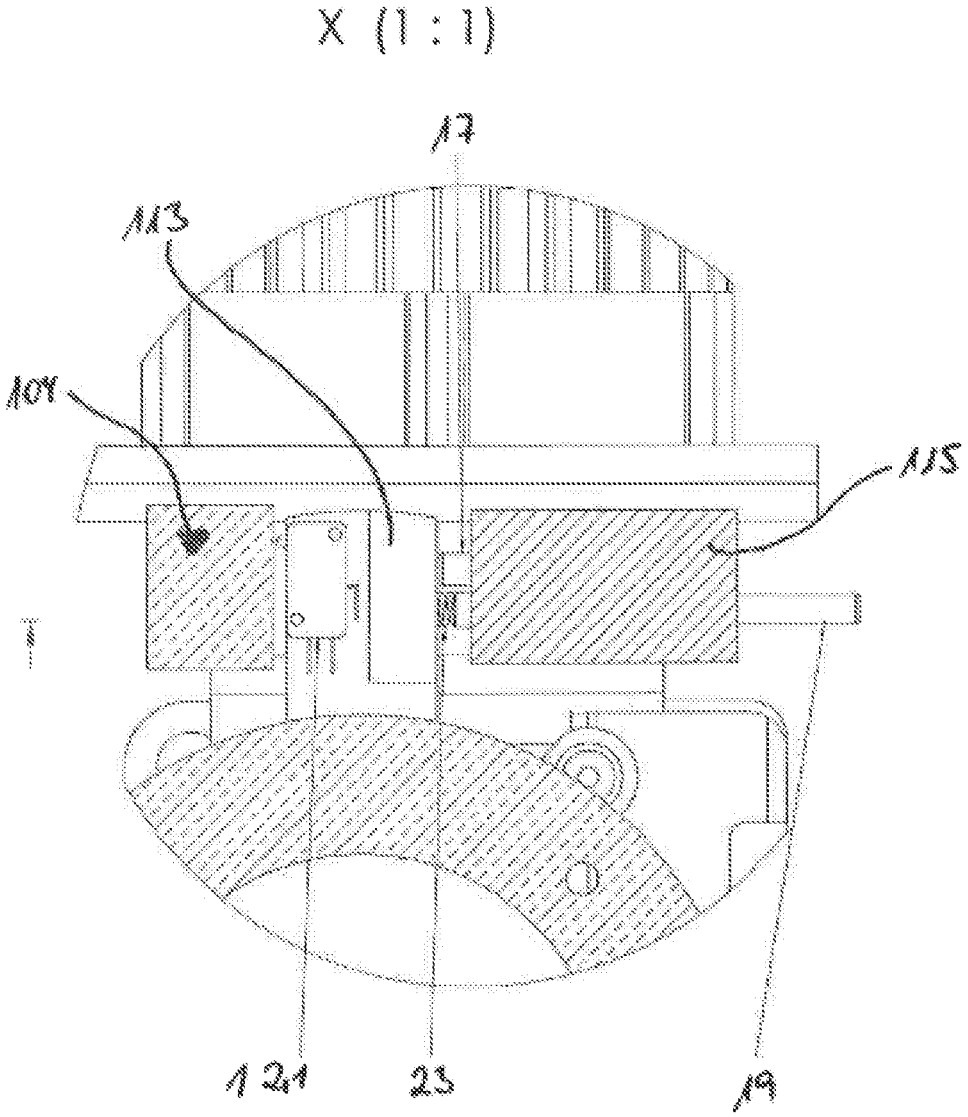
FIG. 8 is an enlarged view of a portion of the partial cross-sectional view illustrated in FIG. 7.

The operating method of the endless cable winch 1 and in particular the lifting force limiting device according to the second exemplary embodiment of the disclosure results from viewing FIG. 8, in connection with FIGS. 6 and 7. As shown in the illustrated embodiment, the endless cable winch 101 can have a switch 121, which is firmly connected to the output unit 105, the casing 104, or both. In the position shown in FIG. 8, the switch 121 is in an open position, resulting from the fact, that the drive-side support structure 113 and the output-side support structure 115 are approximated to one another and at a predetermined minimum distance, preferably also according to the second exemplary embodiment, through the end position of drive-side support structure 113 at the casing 104 and/or in this case realized at the switch 121, is not achieved.

According to the second exemplary embodiment restoring element 23, bearing member 19 and damping element 17 can also be included. The first exemplary embodiment and the second exemplary embodiment also have in common that the drive of engine 7 is released as long as switch 21, 121 is closed. In the simplest case, the switch 21, 121 is opened through the approximation of the drive side support structure 13, 113 and the output-side support structure 15, 115 to one another and consequently through a failure to achieve the predetermined minimum distance and an electrical circuit is transitioned from the previous state (closed) into a new state (opened). In doing so, thereupon, the control of the engine 7 is caused to turn it off. This can take place with the aid of (not shown) an electric control unit. The electronic control unit is preferably configured according to the preferred embodiments of the disclosure.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Although the disclosure has been described in detail, it should be understood that various changes, substitutions, and alterations can be made herein without departing from the spirit and scope of the invention as defined by the appended claims. Moreover, the scope of the present disclosure is not intended to be limited to the particular embodiments described in the specification. As one of ordinary skill in the art will readily appreciate from the disclosure of the present invention, processes, machines, manufacture, composition of matter, means, methods, or steps, presently existing or later to be developed that perform substantially the same function or achieve substantially the same result as the corresponding embodiments described herein may be utilized according to the present disclosure.

What is claimed:

1. An endless cable winch comprising:

a drive unit having an engine configured to generate torque;

an output unit connected to the drive unit, the output unit including a coupled power transmission assembly configured to apply a driving force onto an endless cable coupled to the drive unit, and wherein the endless cable is passed through the output unit; and a lifting force limiting device configured to stop the drive unit when a predetermined drive force is exceeded, wherein the engine and the output unit are movable relative to one another, and the lifting force limiting device is configured to stop the drive unit based on the relative movement of the drive unit and the engine.

2. The endless cable winch according to claim 1, wherein the engine and the output unit are supported against each other via a torque arm, and the torque arm features both a drive-side support structure and an output-side support structure.

3. The endless cable winch according to claim 2, wherein the lifting force limiting device includes a switch configured to switch off the drive unit in case drive-side support structure and the output-side support structure fail to achieve a predetermined minimum distance to each other.

4. The endless cable winch according to claim 3, wherein the switch is contact-sensitive and configured to switch off the drive unit when the drive-side support structure and the output-side support structure touch each other.

5. The endless cable winch according to claim 2, wherein the lifting force limiting device includes a restoring element configured to apply a restoring force directed against an approximation movement of the drive-side support structure and the output-side support structure.

6. The endless cable winch according to claim 5, wherein the lifting force limiting device includes a biasing element configured to apply a biasing force to the restoring element directed against the approximation movement of the drive-side support structure and the output-side support structure.

7. The endless cable winch according to claim 2, wherein the drive unit includes a transmission, which is rotatably positioned relative to the engine and non-rotatably connected to the drive unit, and the drive side support structure is non-rotatably connected to the engine.

8. The endless cable winch according to claim 2, wherein the drive unit includes a transmission, which is non-rotatably connected to the engine and rotatably positioned relative to the drive unit and the drive side support structure is non-rotatably connected to at least one of the engine and the transmission.

9. The endless cable winch according to claim 2, further comprising an electronic control device configured to interact with the drive unit and the lifting force limiting device in such a signal-processing way, that a first signal generated by a switch representing a value below a predetermined minimum distance is transmitted to the control device and on this basis a control command to stop the drive unit is transmitted to drive unit.

10. The endless cable winch according to claim 9, wherein the control device is configured such that when a predetermined minimum distance between the drive-side support structure and the output-side support structure is not achieved the control device: 1) holds the endless cable winch in a constant position relative to the endless cable, or 2) lowers the endless cable winch along the endless cable.

11. The endless cable winch according to claim 9, wherein the control device is configured to release the drive unit if the predetermined minimum distance has been achieved or exceeded.

12. The endless cable winch according to claim 1, wherein the lifting force limiting device includes a damping element configured to delay an approximation movement of a drive-side support structure and an output-side support structure.

13. The endless cable winch according to claim 1, wherein the drive unit includes a casing and an output side support structure is firmly connected to the casing.

* * * * *